United States Patent [19]

Kennedy et al.

[11] Patent Number: 4,983,273

[45] Date of Patent: Jan. 8, 1991

[54] HYDROCRACKING PROCESS WITH PARTIAL LIQUID RECYCLE

[75] Inventors: Clinton R. Kennedy, West Chester, Pa.; Stuart S. Shih, Cherry Hill, N.J.; Robert A. Ware, Wyndmoor, Pa.

[73] Assignee: Mobil Oil Corporation, Fairfax, Va.

[21] Appl. No.: 417,410

[22] Filed: Oct. 5, 1989

[51] Int. Cl.[5] ..... C10G 69/10

[52] U.S. Cl. ..... 208/89; 208/111; 208/254 H

[58] Field of Search ..... 208/89, 57, 59, 111; 258/254 H

[56] References Cited

U.S. PATENT DOCUMENTS

| | | | |
|---|---|---|---|
| 3,684,694 | 8/1972 | Hanson et al. | 208/57 |
| 3,759,819 | 9/1973 | Attane et al. | 208/57 |
| 4,419,218 | 12/1983 | Angevine et al. | 208/59 |
| 4,612,108 | 9/1986 | Angevine et al. | 208/111 |
| 4,647,368 | 3/1987 | McGuiness et al. | 208/70 |
| 4,689,312 | 8/1987 | Ngoc Le et al. | 502/38 |
| 4,764,266 | 8/1988 | Chen et al. | 208/59 |
| 4,851,109 | 7/1989 | Chen et al. | 208/18 |

*Primary Examiner*—Anthony McFarlane

*Attorney, Agent, or Firm*—Alexander J. McKillop; Charles J. Speciale; Malcolm D. Keen

[57] ABSTRACT

A hydrocracking process employing a hydrocracking catalyst based on zeolite beta together with a metal hydrogenation/dehydrogenation component recycles the unconverted, hydrocracked bottoms fraction to the hydrocracking step for improvements in distillate selectivity and denitrogenation without loss of catalyst activity while improving dewaxing of the unconverted bottoms fraction. The process typically operates at low to moderate hydrogen pressures up to 1500 psig (10445 kPa) with low hydrogen consumptions typically below 800 SCF/Bbl (142 n.l.l.$^{-1}$). Denitrogenation is notably high at 90 weight percent or higher.

9 Claims, 7 Drawing Sheets

HYDROCRACKING PROCESS WITH PARTIAL LIQUID RECYCLE

FIELD OF THE INVENTION

This invention relates to a hydrocracking process and more particularly to a hydrocracking process using a hydrocracking catalyst based on zeolite beta. The process employs a partial recycle of the hydrocracked bottoms fraction which has been found to improve distillate selectivity without decreasing catalyst activity while achieving improved pour point for the bottoms fraction.

BACKGROUND OF THE INVENTION

Hydrocracking is a well established process in the petroleum refining industry and is conventionally employed either for fuels (distillate) production or for producing lubricants from poor or marginal quality crude sources. In both types of hydrocracking operation, the feed, usually a high boiling material such as a vacuum gas oil (VGO) or a catalytically cracked fraction such as light cycle oil (LCO) or heavy cycle oil (HCO) is contacted with a bifunctional catalyst in the presence of hydrogen under elevated temperatures and pressures. The catalyst has an acidic function which is typically provided by an amorphous support such as alumina or silica-alumina or by a large pore size crystalline zeolite such as zeolite X or zeolite Y. Large pore size materials of this type are used in hydrocracking operations in order that the bulky, polycyclic aromatic components in the typical feedstocks may obtain access into the internal pore structure of the catalyst where the characteristic hydrocracking reactions mostly take place. The metal function is provided in order to promote the hydrogenation reactions which occur and is usually provided by means of a base metal of Group VIA or VIIIA of the Periodic Table (IUPAC Table) such as nickel, cobalt, tungsten or molybdenum or, in some cases, by a noble metal such as platinum or palladium. Combinations of base metals from both Groups VIA and VIIIA are preferred, for example, nickel-tungsten, cobalt-molybdenum have been found to provide superior results. Other metals may be present to promote or suppress certain hydrogenative type functions, for example, tin may be present as described in U.S. Pat. No. 3,535,227. Temperatures in hydrocracking are typically at least about 500° F. (about 260° C.) and are typically in the range of 650°–850° F. (about 345–455° C.) with higher temperatures being disfavored for thermodynamic reasons. Hydrogen pressures are typically at least about 400 psig (about 2860 kPa abs.) and depending upon the mode of operation are frequently in the range of about 1000 to 2500 psig (about 7000 to 17,340 kPa abs.). Hydrogen circulation rates are typically at least about 1000 to 5000 SCF/Bbl (about 180 to 890 n.l.l.). Space velocities are typically about 0.5 to 5, more commonly 0.5 to 2 LHSV ($hr.^{-1}$).

As described above, hydrocracking conventionally employs a support material having acidic functionality such as amorphous alumina, silica-alumina or a crystalline support such as the large pore size zeolites e.g. zeolite X or zeolite Y. Recently, the use of zeolite beta for this purpose has been proposed and it has been found to possess a number of significant advantages for the hydrocracking process. It has been shown that zeolite beta, unlike typical large pore size hydrocracking catalyst supports such as zeolite X and zeolite Y, is paraffin-selective in the presence of aromatics and tends to convert paraffins in the feed in preference to the aromatics with a preferential mode of attack towards the relatively high boiling paraffins. Moreover, zeolite beta possesses a marked propensity to isomerize the higher molecular weight paraffins so that not only is it able to effect a bulk conversion of the feed by cracking to lower boiling range products but, in addition, is able to isomerize waxy paraffins which are present in the feed to less waxy isoparaffins so that a marked reduction of product pour point is noted, especially in the bottoms fraction (usually 650° F.+, 345° C.+). By contrast, conventional zeolite and amorphous hydrocracking catalysts are generally aromatic selective so that aromatics in the feed are converted in preference to paraffins. This behavior is illustrated in European Patent Application Publication No. 94827 which compares the results of hydrocracking using a zeolite beta based catalyst and a catalyst based on zeolite Y. The use of the conventional zeolite Y based catalyst results in a significant net increase in the proportion of paraffins in the high boiling fraction with a major reduction in the proportion of aromatics. By contrast, the zeolite beta based catalyst effects a significantly smaller increase in paraffins and a smaller decrease in aromatic content. At the same time, the pour point of the high boiling fraction is significantly reduced by the use of zeolite beta while remaining essentially unchanged with the conventional hydrocracking catalyst (see Examples 3 and 4 of EP No. 94827).

Other hydroprocessing applications exploiting the properties of zeolite beta have been described in the patent literature. See, for example, U.S. Pat. Nos. 4,554,065, 4,568,655, 4,501,926, 4,518,485 and EP No. 163,449.

In conventional hydrocracking operations, a hydrotreater usually preceeds the hydrocracking reactor in order to effect a preliminary saturation of aromatics present in the feed and, in addition, to convert organic nitrogen and sulfur to inorganic forms (ammonia, hydrogen sulfide) which may optionally be removed in an interstage separation prior to entering the hydrocracking reactor or reactors in which the conversion to lower boiling products takes place. In a typical fuels hydrocracking operation where the objective is to maximize naphtha and distillate production, the unconverted fraction may be recycled to extinction, either in a second stage reactor or by recycle to the first stage hydrocracking reactor. Operation with two hydrocracking reactors is frequently preferred in order to extend catalyst cycle life, with the total conversion being split between the two hydrocracking reactors. In a lube hydrocracking operation, the high boiling lube product is preserved although lower boiling materials including naphtha and distillate are removed for separate disposition. In this case, however, the objective of the process is to effect a conversion of aromatics to materials which are relatively more paraffinic and which have better properties as lubricants. This is effected both by a process of ring saturation to naphthenic type materials as well as to saturation followed by ring opening reactions to form paraffinic chains which may, however, remain attached to aromatic moieties.

As described above, fuels hydrocracking generally operates with extinction recycle to convert the feed to lower boiling materials, typically to 650° F.- (about 345° C.-) products, usually with major amounts of naphtha. To do this, the recycle conventionally enters between the hydrotreater and the hydrocracker, either upstream or downstream of the interstage separator.

SUMMARY OF THE INVENTION

It has now been found that partial recycle of the unconverted fraction from a hydrocracking process employing zeolite beta hydrocracking catalysts improves distillate selectivity and, moreover, is capable of doing this without decreasing catalyst activity in preferred process configurations. In addition, recycling of the unconverted fraction provides improved dewaxing of the bottoms fraction.

According to the present invention there is therefore provided a process for hydrocracking a high boiling point hydrocarbon feed in which a hydrotreated feed is cascaded to a hydrocracking step using a hydrocracking catalyst comprising zeolite beta and a metal hydrogenation/dehydrogenation component to effect a conversion of the feed to lower boiling range hydrocracked products in the presence of hydrogen at elevated temperature and pressure. The hydrocracked effluent is fractionated and a portion of the unconverted fraction is recycled to the hydrocracking step. Overall conversion to lower boiling products is not more than 70 wt. percent, usually in the range of 20 to 60 percent and conversion per pass is typically no more than 45 percent, usually not more than 35 percent. Denitrogenation is usually of a high order, at least 90 weight percent or higher e.g. 92 weight percent. Typically, the feed will be a 650° F.+ (about 345° C.+) petroleum refinery fraction and the unconverted fraction will also be a 650° F.+ (about 345° C.+) fraction also with a significant portion of the product in the 330°-650° F. (about 165°-345° C.) boiling range.

THE DRAWINGS

DETAILED DESCRIPTION

Feedstock

Figure 1:
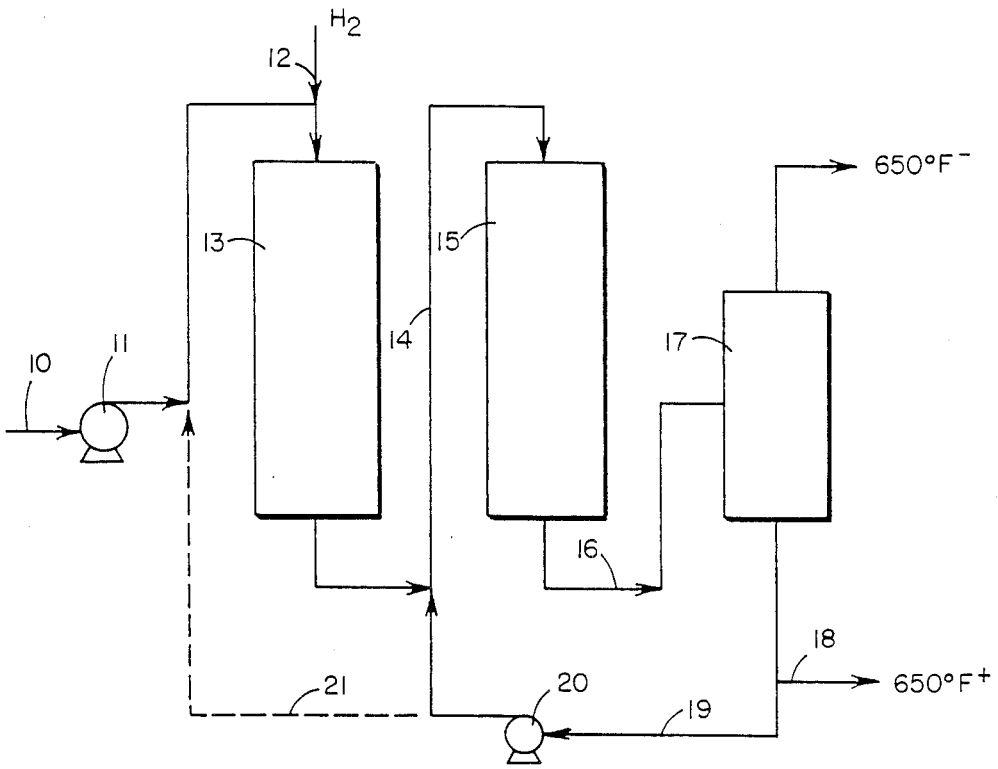
FIG. 1 is a simplified schematic showin the operation of a hydrocracking process with partial recycle of the unconverted fraction.

The present hydrocracking process operates with a heavy hydrocarbon feedstock such as a gas oil, coker tower bottoms fraction, reduced crude, vacuum tower bottoms, deasphalted vacuum resids, FCC tower bottoms, or cycle oils. Oils derived from coal, shale, or tar sands may also be treated in this way. Oils of this kind generally boil above 343° C. although the process is also useful with oils which have initial boiling points as low as 260° C. These heavy oils comprise high molecular weight long chain paraffins and high molecular weight aromatics with a large proportion of fused ring aromatics. During the processing, the fused ring aromatics and naphthenes are cracked by the acidic catalyst and the paraffinic cracking products, together with paraffinic components of the initial feedstock, undergo conversion to iso-paraffins with some cracking to lower molecular weight materials. Hydrogenation of the polycyclic aromatics is catalyzed by the hydrogenation component and facilitates cracking of these high molecular weight fused-ring structures to lower weight monocyclic compounds. Hydrogenation of unsaturated side chains on the monocyclic cracking residues of the original polycyclics forms substituted monocyclic aromatics which are highly desirable end products. The heavy hydrocarbon oil feedstock will normally contain a substantial amount boiling above 450° F. (about 230° C.) and will normally have an initial boiling point of about 550° F. (about 290° C.), more usually about 650° F. (about 345° C.). Typical boiling ranges will be about 650° to 1050° F. (about 345° to 565° C.) or 650° to 950° F. (about 345° C. to 510° C.) but oils with a narrower boiling range may, of course, be processed, for example, those with a boiling range of about 650° to 850° F. (about 345° to 455° C.). Heavy gas oils are often of this kind as are cycle oils and other non-residual materials. Cycle oils from catalytic cracking operations (FCC and TCC) are particularly useful, including light cycle oils (LCO) typically with boiling ranges from about 350° to 700° F. (about 175° to 370° C.) e.g. 440° to 650° F. (about 225° to 345° C.) or heavy cycle oils with end points up to about 800° or 850° F. (about 425° or 455° C.). Most feeds such as these will contain significant levels of polycyclic aromatics. It is possible to co-process materials boiling below 500° F. (about 260° C.) but the degree of conversion will be lower for such components. Feedstocks containing lighter ends of this kind will normally have an initial boiling point above 300° F. (about 150° C.).

Process Conditions

The process is carried out under conditions similar to those used for conventional hydrocracking although the use of the highly siliceous zeolite catalyst permits the total pressure requirement to be reduced. Process temperatures of about 500° F. to 900° F. (about 260° to 480° C.) may conveniently be used although temperatures above 850° F. (about 455° C.) will normally not be employed as the thermodynamics of the hydrocracking reactions become unfavorable at temperatures above this point. Generally, temperatures of 600° to 800° F. (about 315° C. to 425° C.) will be employed. Total pressure is usually in the range of 500 to 1500 psig (3550 to 10,445 kPa) and the higher pressures within this range over 1000 psig (7000 kPa) will normally be preferred. The process is operated in the presence of hydrogen and hydrogen partial pressures will normally be at least 600 psig (4240 kPa). The ratio of hydrogen to the hydrocarbon feedstock (hydrogen circulation rate) will normally be from 100 to 5000 SCF/Bbl (about 18 to 890 n.l.l.$^{-1}$). The space velocity of the feedstock will normally be from 0.1 to 10 LHSV (hr$^{-1}$), preferably 0.5 to 5 LHSV. At low conversions, the n-paraffins in the feedstock will be isomerized to iso-paraffins but at higher conversion under more severe conditions the iso-paraffins will be converted to lighter materials.

The conversion may be carried out by contacting the feedstock with a fixed stationary bed of catalyst, a fixed fluidized bed or with a transport bed. A simple configuration is a trickle-bed operation in which the feed is allowed to trickle through a stationary fixed bed. With such a configuration, it is desirable to initiate the reaction with fresh catalyst at a moderate temperature which is of course raised as the catalyst ages, in order to maintain catalytic activity. The catalyst may be regenerated by contact at elevated temperature with hydrogen gas, for example, or by burning in air or other oxygen-containing gas.

A preliminary hydrotreating step using a conventional hydrotreating catalyst to remove nitrogen and sulfur and to saturate aromatics to naphthenes without substantial boiling range conversion will usually improve catalyst performance and permit lower tempertatures, higher space velocities, lower pressures or combinations of these conditions to be employed. Suitable hydrotreating catalysts generally comprise a metal hydrogenation component, usually a Group VIA or VIIIA metal as described above e.g. cobalt-molybdenum, nickel-molybdenum, on a substantially non-acidic porous support e.g. silica-alumina or alumina.

Hydrocracking Catalyst

The catalyst used in the present hydrocracking process is similar to conventional hydrocracking catalysts using an acidic large pore size zeolite within the porous support material with an added metal hydrogenation/-dehydrogenation function with the exception that the porous, acidic support material comprises zeolite beta. Hydrocracking catalysts employing zeolite beta are described in EP No. 94827 and U.S. Pat. No. 4,820,402 to which reference is made for a description of such catalysts. Briefly, the catalyst comprises zeolite beta together with a metal component which has hydrogenation/dehydrogenation functionality. The catalyst is required to have a degree of cracking activity which is provided by the zeolite with suitable framework silica; alumina ratios ranging from 30:1 to 500:1, and higher, typically employed. Suitable metal components are those described above, for example, transition metals of Group VIA and VIIIA of the Periodic Table with preference being given to combinations of metals from Groups VIA and VIIIA e.g. nickel-tungsten, cobalt-molybdenum either alone or with other metals such as tin, for instance. Noble metals such as platinum and palladium may also be employed. The amount of metals on the catalyst are conventional, typically being up to about 25 weight percent for base metals and no more than 10 percent for the more active noble metals, especially platinum. The metal component may be incorporated with the support component by conventional methods such as ion exchange, impregnation or a combination of the two using either simple salts or cationic complexes such as $Pt(NH_3)_4$ or anionic complexes such as metatungstate, as appropriate. When using anionic complexes such as metatungstate, impregnation techniques are appropriate because the metal containing anions will not be exchanged onto the zeolite.

The catalysts preferably include a binder such as silica, silica/alumina or alumina or other metal oxides e.g. magnesia, titania, and the ratio of binder to zeolite will typically vary from 10:90 to 90:10, more commonly from about 30:70 to about 70:30 (by weight).

Process Configuration

It has been found that by partially recycling the unconverted fraction of the feed to the hydrocracking process, distillate selectivity in the cascade hydrotreating/hydrocracking process (no interstage separation) is improved. Recycling of this fraction to the hydrocracking catalyst alone is preferred because improved distillate selectivity has unexpectedly been found to be obtained without deterioration in catalyst boiling range conversion activity whereas recycle to the preliminary hydrotreating step appears to result in loss of activity. In addition, recycle to the hydrocracking catalyst has been found to provide better dewaxing of the unconverted fraction, usually 650° F.+ (about 345° C.+) bottoms with the result that the distillate product has a notably lowered Pour Point (ASTM D-97).

FIG. 1 shows in simplified form a flow sheet for the present process. A high boiling hydrocarbon feed e.g. 650° F.+ VGO (about 345° C.+) enters the process through feed inlet 10 and feed pump 11 and after addition of hydrogen from line 12 passes through a hydrotreater 13. For simplicity, the hydrogen circuit, which is conventional, is not shown. The hydrotreating catalyst comprises a typical hydrotreating catalyst, for example, nickel-molybdenum on alumina or cobalt-molybdenum on alumina and hydrotreating conditions will be typical of those employed in this stage of the hydrocracking process. The hydrotreated feed is then cascaded (no interstage separation of inorganic heteroatom compounds or light ends) through line 14 to the hydrocracking reactor 15 which contains the zeolite beta hydrocracking catalyst, together with additional hydrogen if necessary. The hydrocracking reactor itself is conventional and may include provision for hydrogen quench and flow distributors at intermediate points along the length of the reactor. In this reactor the characteristic zeolite beta-catalyzed hydrocracking reactions take place to produce a hydrocracked effluent which passes through the normal high pressure and low pressure separators (not shown) before being passed through line 16 to be fractionated in the fractionating tower 17. Various hydrocracked fractions may be taken out at this point, including naphtha, kerosene, middle distillate and bottoms but for simplicity, a two way split into 650° F.- (about 345° C.-) and 650° F.+ (about 345° C.+) bottoms is shown with the 650° F.- (about 345° C.-) being withdrawn as product. Part of the bottoms fraction is withdrawn through line 18 and the remainder is recycled to the hydrocracking reactor through line 19 and recycle pump 20. Optionally, recycle may be taken additionally or alternatively to the inlet of the hydrotreating reactor 13 through line 21.

Because the zeolite beta is effective for reducing the pour point of the extended distillate fraction boiling above about 650° F. (about 345° C.), it is possible to utilize an extended boiling range distillate product without violating many product specifications and by so doing the distillate pool may be effectively increased. If this is done, the recycle cut point may be higher e.g. at 700° F. (about 370° C.), 730° F. (about 390° C.), 750° F. (about 400° C.) or 775° F. (about 415° C.), with the components boiling above the selected cut point being recycled to the hydrocracker.

The recycle ratio i.e. the ratio of recycle material to fresh feed to the process typically varies from at least 0.25:1 (recycle:fresh feed) or higher but is preferably maintained at a value of at least 0.5:1 (by weight, recycle:fresh HDC feed). As shown below, the use of recycle ratios of this magnitude produces advantageous results. Normally, recycle ratios above 1:1 will not be preferred.

Interstage separation between the hydrotreating reactor and the hydrocracking reactor is not employed. As shown below, the improved results are obtained by cascading the hydrotreated effluent directly into the hydrocracking reactor without separation of the heteroatom-containing impurities in inorganic form ($NH_3$,$H_2S$). If suitable equipment is available, the hydrotreating catalyst may be loaded directly on top of the hydrocracking catalyst to permit cascade operation in a single vessel.

The catalyst ratio will typically vary from 1:5 to 5:1 (HDT:HDC, by volume) and generally will be from 1:2 to 2:1 V/V.

More than one hydrotreating or hydrocracking reactor may be used and the use of two reactors to provide two stage hydrocracking with recycle of the unconverted bottoms fraction to the second hydrocracking stage with the total conversion split between the two stages is an appropriate expedient for the present process.

Besides increasing the selectivity for distillate products boiling above the naphtha boiling range (typically 330° F. end point), the present process also produces improvements in product quality, notably in product pour point (ASTM D-97) and Diesel Index (Diesel Index is the product of the Aniline Point (° F.) and API Gravity/100; Aniline Point is determined by ASTM D-611). The degree of desulfurization and denitrogenation is also remarkably improved at a relatively low hydrogen consumption, typically under 1000 SCF/Bbl (about 180 n.l.l.$^{-1}$) at 650° F.+ conversions up to about 70 percent by weight.

The extent of the denitrogenation achieved in single-pass operation is notable. In the presence of recycle, the degree of denitrogenation would be expected to be maintained or even increase due to repeated contacting of the unconverted 650° + fraction with the hydrotreating and hydrocracking catalyst. It has been found that when the recycle is taken to the hydrotreater, the expected denitrogenation activity is, however, not obtainedand a loss in nitrogen removal is observed. When, however, the recycle is injected downstream of the hydrotreater but ahead of the hydrocracker, the degree of denitrogenation is significantly improved and may, in fact, exceed the denitrogenation for single pass operation under otherwise identical process conditions. In favorable cases, the denitrogenation will exceed 90 percent e.g. 92 percent or higher, even at 650° F.+ conversions as low as 20 weight percent. At conversions of 40–60 percent, the denitrogenation may be as high as 96 percent.

EXAMPLES 1, 2

These Examples demonstrate the effect of recycling the unconverted bottoms fraction to the hydrotreating (HDT) catalyst at different pressures.

The experiments were carried out in a pilot unit employing a commercial $NiMo/Al_2O_3$ hydrotreating (HDT) catalyst and a NiW zeolite beta hydrocracking (HDC) catalyst. The properties of the two catalysts are shown in Table 1 below.

TABLE 1

| | Catalyst Properties | |
|---|---|---|
| | Hydrotreating | Hydrocracking[1] |
| Physical Properties | | |
| Packed Density, g/cc | 0.877 | 0.73 |
| Particle Density, g/cc | 1.43 | 1.15 |
| Surface Area, $M^2/g$ | 138 | 292 |
| Pore Volume, cc/g | 0.389 | 0.558 |
| Av. Pore Diameter, A | 113 | 76 |
| Chemical Compositions. wt % | | |
| Nickel | 3.9 | 4.0 |
| Molybdena | 13.7 | — |
| Tungsten | — | 15.5 |
| Silica | 0.11 | — |

[1]contains 50 wt % zeolite beta prior to metals addition

The pilot unit was operated by cascading effluent from the first reactor directly into the second without removal of ammonia and hydrogen sulfide at the interstate. The feedstock for the experiments was a nominal 650°–1050° F. (about 345°–565° C.) Persian Gulf Light VGO having the properties shown in Table 2 below.

TABLE 2

| Persian Gulf VGO Feedstock Properties | | |
|---|---|---|
| General Properties | | |
| Gravity, API° | | 22.5 |
| Hydrogen, wt % | | 12.31 |
| Sulfur, wt % | | 2.50 |
| Nitrogen, ppmw | | 640 |
| Basic Nitrogen, ppmw | | 222 |
| Pour Point, °F. | | 100 |
| Aniline Point, °F. | | 179.5 |
| KV @ 40° C., cs | | 63.21 |
| KV @ 100° C., cs | | 7.01 |
| Composition. wt % | | |
| Paraffins | | 22.2 |
| Naphthenes | | 23.9 |
| Aromatics | | 53.9 |
| Distillation, °F. | D1160 | D2887 |
| IBP | 602 | 551 |
| 5% | 670 | 630 |
| 10% | 698 | 667 |
| 30% | 776 | 761 |
| 50% | 833 | 829 |
| 70% | 859 | 901 |
| 90% | 970 | 994 |
| 95% | 1016 | 1026 |
| EP | 1024 | 1104 |

The conditions employed for the experiments included temperatures from 720°–800° F. (about 380°–425° C.), 0.5 LHSV (based on fresh feed relative to total HDT+HDC catalyst), 4000 SCF/Bbl (712 n.l.l.$^{-1}$) of once-through hydrogen circulation and hydrogen partial pressures of 795 psia (5480 kPa) and 1015 psia (7000 kPa).

Figure 2:
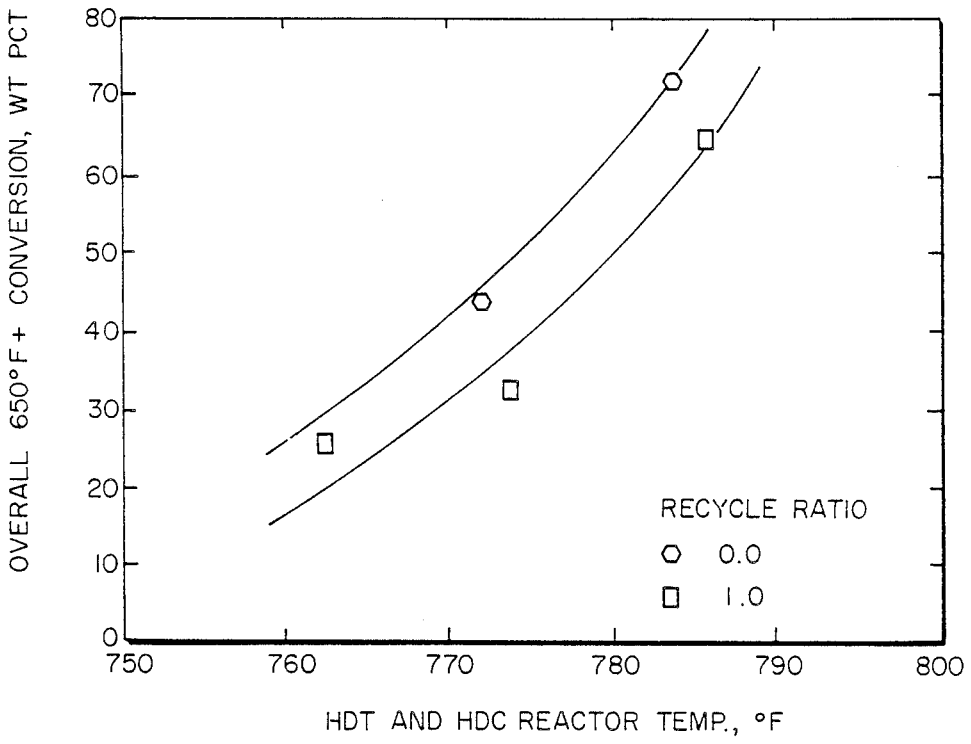
FIGS. 2 to 7 are graphs showing the effect of recycle on a hydrocracking process using a zeolite beta catalyst.

FIG. 2 shows the results of an experiment conducted at 1015 psia (7000 kPa) hydrogen partial pressure with the 650° F.+ (about 345° C.+) bottoms recycled to the hydrotreating catalyst. During the experiment, both catalysts were maintained at the same temperature which was adjusted simultaneously to achieve different conversions. The results shown in FIG. 2 demonstrate that under these conditions the liquid recycle resulted in a loss of catalyst activity relative to the once-through operation with no recycle. At a recycle ratio of 1.0 the catalyst system lost 6° F. (about 3° C.) activity at 50 percent conversion to 650° F.-(about 345° C.-) products, equivalent to a decrease of 10 percent conversion at the same reactor temperature.

Figure 3:
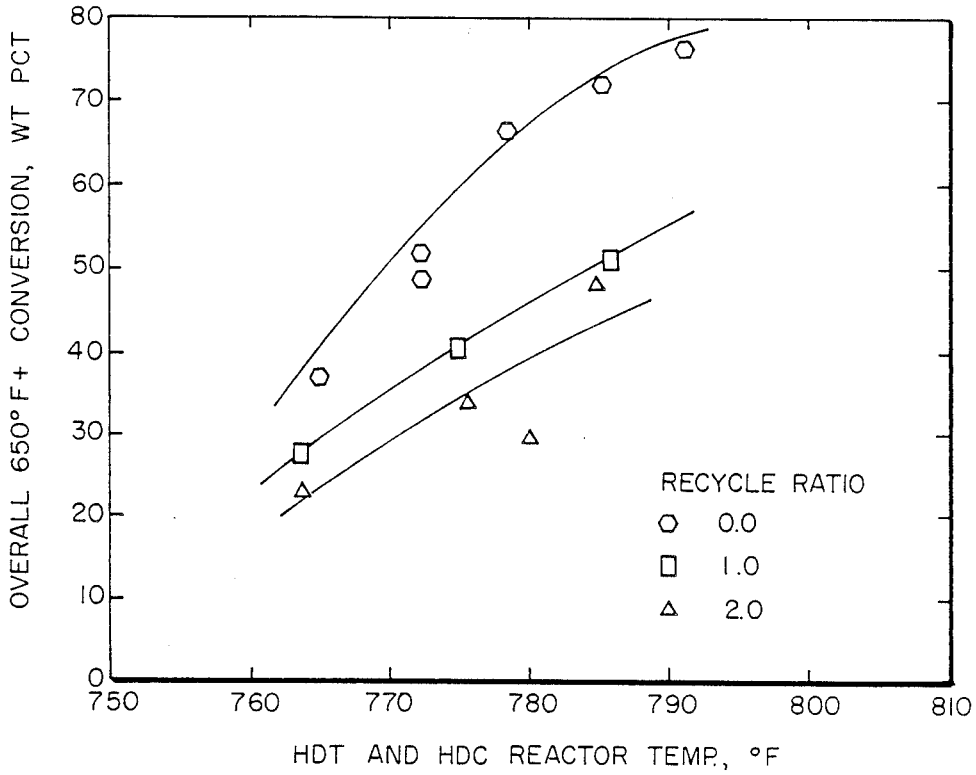

In a similar experiment conducted at 795 psia (5480 kPa) the results shown in FIG. 3 again demonstrate a loss in catalytic activity with recycle to the HDT reactor. A greater loss in activity is observed as the recycle ratio is increased.

EXAMPLE 3

This example illustrates the results for boiling range conversion activity achieved by recycling the unconverted hydrocracked fraction to the hydrocracking (HDC) catalyst.

This experiment was conducted at 1015 psia (7000 kPa) hydrogen pressure and the 650° F.+ (345° C.+) bottoms were recycled to the HDC catalyst. Prior to the recycle study, the pilot unit was operating at 750° F. in both the HDT and HDC reactors to achieve 50% total conversion. Then, while the HDT catalyst temperature was kept constant at 750° F. (400° C.), the HDC catalyst temperature was varied to obtain different 650° F.+ (345° C.) conversions with and without liquid recycle to the HDC catalyst.

Figure 4:
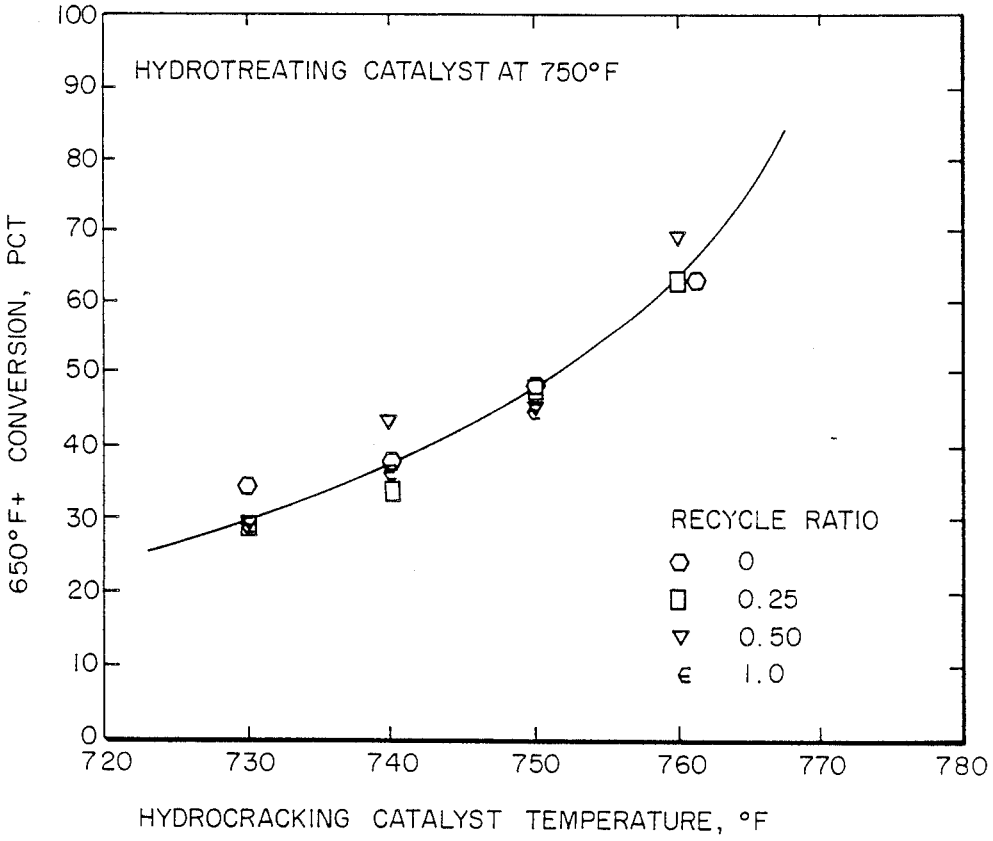
Figure 5:
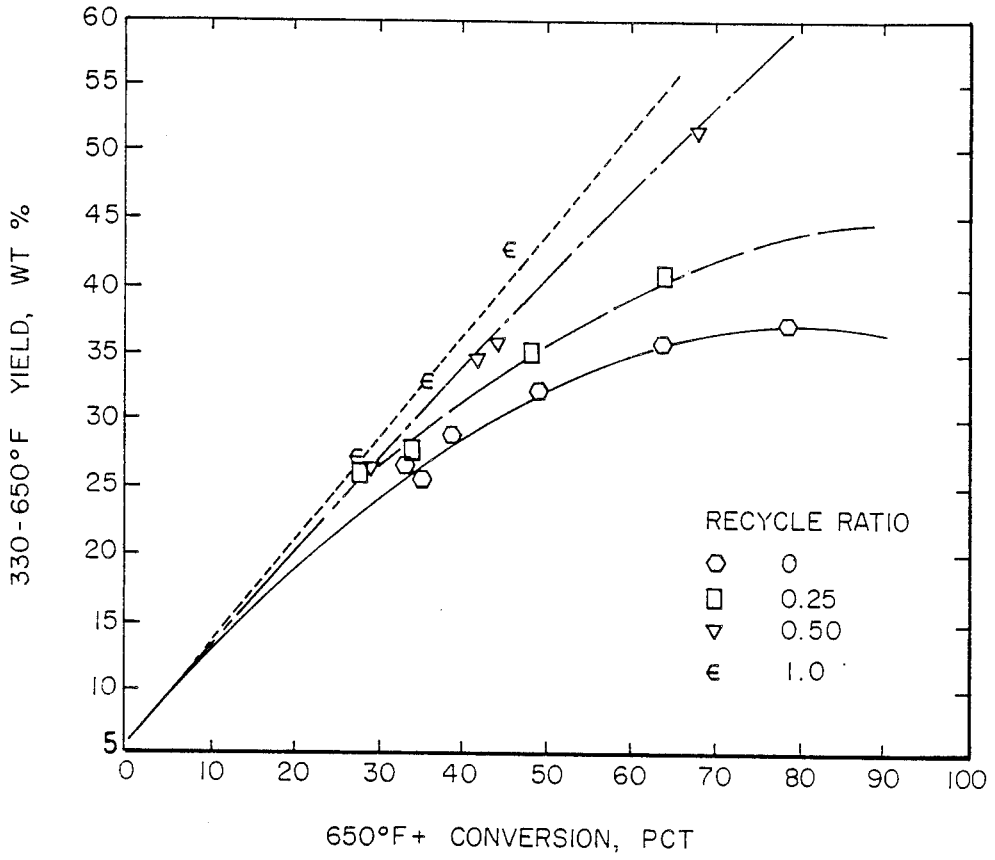

Results in FIG. 4 show that HDC catalyst activity was not affected by the liquid recycle when the 650° F.+ (345° C.+) bottoms were recycled to the HDC catalyst. Under these conditions, the liquid recycle significantly improves 330°-650° F. (165°-345° C.) distillate yield as shown in FIG. 5 relative to the case without recycle. Furthermore, increasing the recycle ratio results in a further improvement in distillate yield. At constant conversion, the higher distillate yield is necessarily obtained at the expense of naphtha and gas.

EXAMPLE 4

This example illustrates the effect of recycle to the HDT or HDC catalyst on the pour point of the 650° F.+ (345° C.+) fraction at equivalent conversion.

Figure 6:
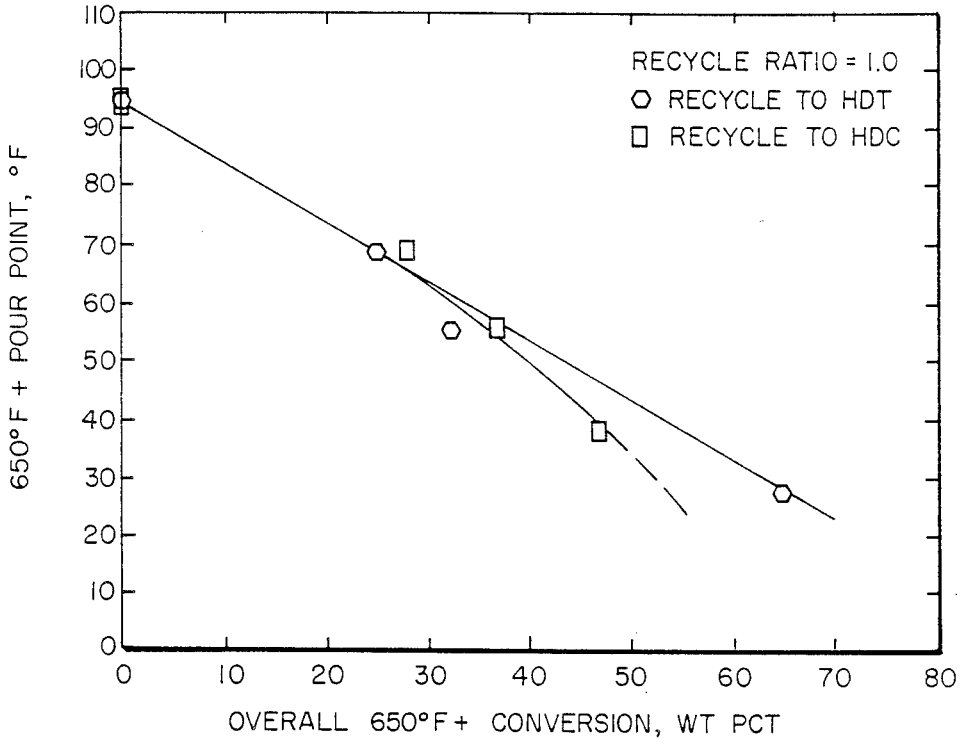

In this example an unexpected reduction in 650° F.+ (345° C.+) pour point at equivalent boiling range conversion is demonstrated by recycling to the HDC stage versus the HDT stage. These experiments were conducted at 1015 (7000 kPa) psia hydrogen with 650° F.+ (345° C.+) liquid recycle to the HDT or HDC catalyst. Conversion was varied as described in the previous examples and the pour point of the resulting 650 F.+bottoms measured. As demonstrated in FIG. 6, improved dewaxing activity, signified by the lower pour point, is attained at conversions greater than about 40% by recycling to the HDC catalyst.

EXAMPLE 5

This example illustrates the improvement in denitrogenation activity achieved by partial recycle operation.

Figure 7:
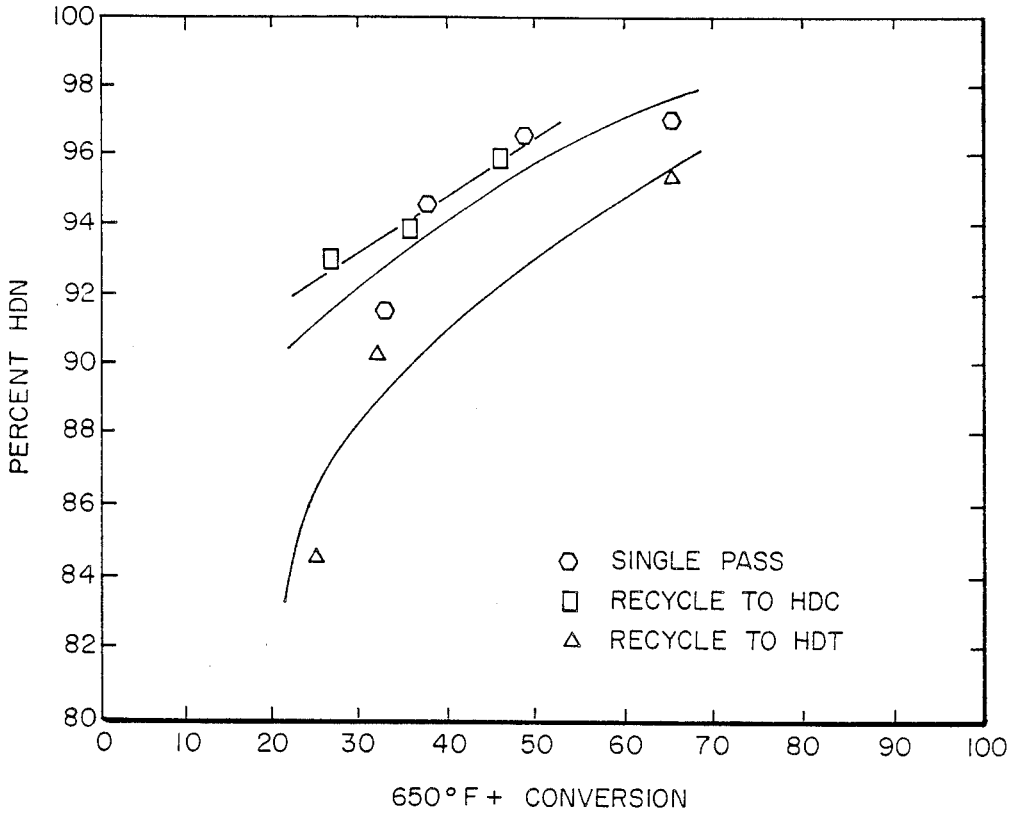

The feed was the Persian Gulf VGO of Table 2 which was subjected to cascade hydrotreating/hydrocracking at 1015 psia hydrogen over the catalysts identified in Table 1. The conditions described in Examples 1 and 2 were used to vary the total conversion between 20 and 70 weight percent. The results obtained at a partial recycle ratio of 1:1 are shown in FIG. 7. The figure establishes the unexpected improvement in denitrogenation activity which is obtained with partial recycle operation to the HDC reactor only.

We claim:

1. A hydrocracking process which comprises:
(i) hydrotreating a 650° F.+ hydrocarbon feed over a catalyst having hydrodenitrogenation and hydrodesulfurization activity,
(ii) passing the hydrotreated feed in cascade to a hydrocracking step in which the feed is hydrocracked by contacting the feed with a hydrocracking catalyst comprising zeolite beta and a hydrogenation/dehydrogenation component in the presence of hydrogen at elevated temperature and pressure to convert the feed to lower boiling products at hydrogen partial pressure from 500 to 2000 psig, a temperature from 600° to 850° F., a space velocity from 0.5 to 10 LHSV and a hydrogen:oil ratio of from 1000 to 5000 SCF/Bbl, a conversion of not more than 60 weight percent per pass to form a hydrocracked effluent and a denitrogenation of at least 90 weight percent;
(iii) fractionating the hydrocracked effluent to form a converted fraction and 650° F.+ unconverted fraction;
(iv) recycling a portion of the 650° F.+ unconverted fraction to the hydrocracking step at a recycle ratio of from 0.25:1 to 5:1 (recycle:fresh food) to effect an overall conversion of not more than 70 weight percent.

2. A process according to claim 1 in which the recycle ratio is from 0.25 to 1:1 (recycle:fresh feed to hydrocracking, by weight).

3. A process according to claim 2 in which the unconverted fraction which is recycled to the hydrocracking step comprises a 730° F.+ fraction.

4. A process according to claim 1 in which the conversion in the hydrocracking step is not more than 45 weight percent per pass to lower boiling products.

5. A process according to claim 1 in which the hydrocracking catalyst comprises zeolite beta and a base metal hydrogenation/dehydrogenation component.

6. A process according to claim 5 in which the base metal hydrogenation/dehydrogenation component comprises nickel and tungsten.

7. A process according to claim 1 in which the hydrocracking is carried out at a hydrogen partial pressure of 500 to 2000 psig, a temperature from 600° to 850° F., a space velocity of from 0.5 to 2 LHSV and a hydrogen:oil ratio of 1000:1 to 5000:1 SCF/Bbl.

8. A hydrocracking process which comprises:
(i) hydrotreating a 650° F.+ hydrocarbon feed over a catalyst having hydrodenitrogenation activity;
(ii) passing the hydrotreated feed in cascade to a hydrocracking step in which the feed is hydrocracked by contact with a hydrocracking catalyst comprising zeolite beta and a hydrogenation/dehydrogenation component in the presence of hydrogen at a pressure of 500 to 2000 psig, at an elevated a temperature from 600° to 850° F., a space velocity of 0.5 to 2 LHSV, and a conversion per pass of 20 to 45 weight percent to 650° F.- lower boiling products and a denitrogenation of at least 90 weight percent, to form a hydrocracked effluent;
(iii) fractionating the hydrocracked effluent to form a converted fraction and a 650° F.+ unconverted fraction;
(iv) withdrawing the converted fraction as product;
(v) recycling a portion of the 650° F.+ unconverted fraction to the hydrocracking step at a recycle ratio of from 0.25:1 to 5:1 (recycle:fresh food) to attain an overall conversion of up to 70 weight percent to lower boiling products.

9. A process according to claim 8 in which the recycle ratio is from 0.25:1 to 1:1 (recycle:fresh feed).

* * * * *